United States Patent [19]

Schmalzbauer

[11] 4,154,443

[45] May 15, 1979

[54] RACING GAME

[76] Inventor: Herbert F. Schmalzbauer, 52 Cedar Lake Rd., Chester, Conn. 06412

[21] Appl. No.: 834,917

[22] Filed: Sep. 20, 1977

[51] Int. Cl.[2] ..... A63F 9/14; A63H 27/04

[52] U.S. Cl. ..... 273/86 H; 272/31 A

[58] Field of Search ..... 273/86 C, 86 H, 95 A; 46/77; 272/31 A, 31 B

[56] References Cited

U.S. PATENT DOCUMENTS

| | | | |
|---|---|---|---|
| 1,090,118 | 3/1914 | Rittenhouse | 272/31 A |
| 2,227,918 | 1/1941 | Trombla | 46/77 X |
| 2,751,226 | 6/1956 | Conway | 273/95 A |
| 3,540,725 | 11/1970 | Hill | 273/1 R |
| 3,762,702 | 10/1973 | Keele et al. | 272/31 A |

*Primary Examiner*—Anton O. Oechsle

*Attorney, Agent, or Firm*—Warren W. Kurz

[57] ABSTRACT

A racing game in which one or more racing objects traverse a closed loop path under the influence of gravity. Each racing object is supported on the free end of a pivotally mounted rod which pivots in a generally horizontal plane about a generally vertical axis. Means are provided for selectively varying the angular position of the pivot axis relative to the gravitational force vector, thereby causing the rod to pivot about the generally vertical axis under the influence of gravity.

9 Claims, 4 Drawing Figures

RACING GAME

BACKGROUND OF THE INVENTION

This invention relates to racing games in which one or more racing objects, such as airplanes, travel along a closed loop path competing against each other or the clock.

A number of racing games have been proposed in the prior art in which racing objects, such as race cars, are propelled along a closed loop path under the influence of gravity. See, for instance, the disclosures of U.S. Pat. No. 1,729,049 issued in the name of C. O. Olsen, and U.S. Pat. No. 2,767,986 issued in the name of M. W. Newberry. Typically, the racing objects move along a closed loop path on a platform which may be tilted in one direction, and then the other, so that the racing objects are continuously moving in downward direction under the influence of gravity. In the Olsen patent a rather elaborate scheme is disclosed for enhancing the speed of the racing objects, such scheme comprising a roller and groove combination, the roller being coupled to the racing object.

A problem with racing games of the type disclosed in the above-noted patents stems from the fact that the racing objects must necessarily traverse closed-loop paths which are unequal in length. Usually, the paths are substantially concentric, the interior path length, of course, being shorter than the outer path. Thus, to assure that the laptime of the racing objects is strictly a function of the skill of the participant, a handicapping scheme must be devised. For instance, in the Olsen reference above it is suggested that the sliding friction of the inner racing object must be made slightly higher than that of the outer racing object. Alternatively, one of the rollers may be made heavier than the other. Regardless of the approach, it should be apparent that accurate handicapping can present a difficult technical problem.

SUMMARY OF THE INVENTION

It is an object of the present invention to provide an improved racing game of the type in which the racing objects are advanced under the influence of the gravitational force.

Another object of the invention is to provide a racing game in which the racing objects traverse identical path lengths, and hence, requires no handicapping system to achieve fairness.

Still another object of the invention is to provide a racing game which is relatively simple, yet durable, in construction.

These and other objects of the invention are achieved by a racing game in which each of the racing objects is mounted for orbital movement about a substantially vertical axis. Each racing object occupies a unique warped horizontal plane, one above the other. Means are provided for tilting the orbital axis of each racing object whereby the gravitational force acts on each racing object to cause it to move about its orbital axis. Preferably, the orbital axes of the racing objects are co-linear and the racing objects are equidistant from the orbital axes. In this manner, each object traverses a closed-loop path of equal length, thereby obviating the need for handicapping one of the objects. Because of the mechanical construction of the mechanism which supports the racing objects, friction is inherently minimized, thereby allowing the racing objects to attain high speeds.

The objects and advantages of the invention will become more apparent to those skilled in the art from the ensuing detailed description of a preferred embodiment, reference being made to the accompanying drawings in which like reference characters designate like parts.

DETAILED DESCRIPTION OF A PREFERRED EMBODIMENT

Figure 1:
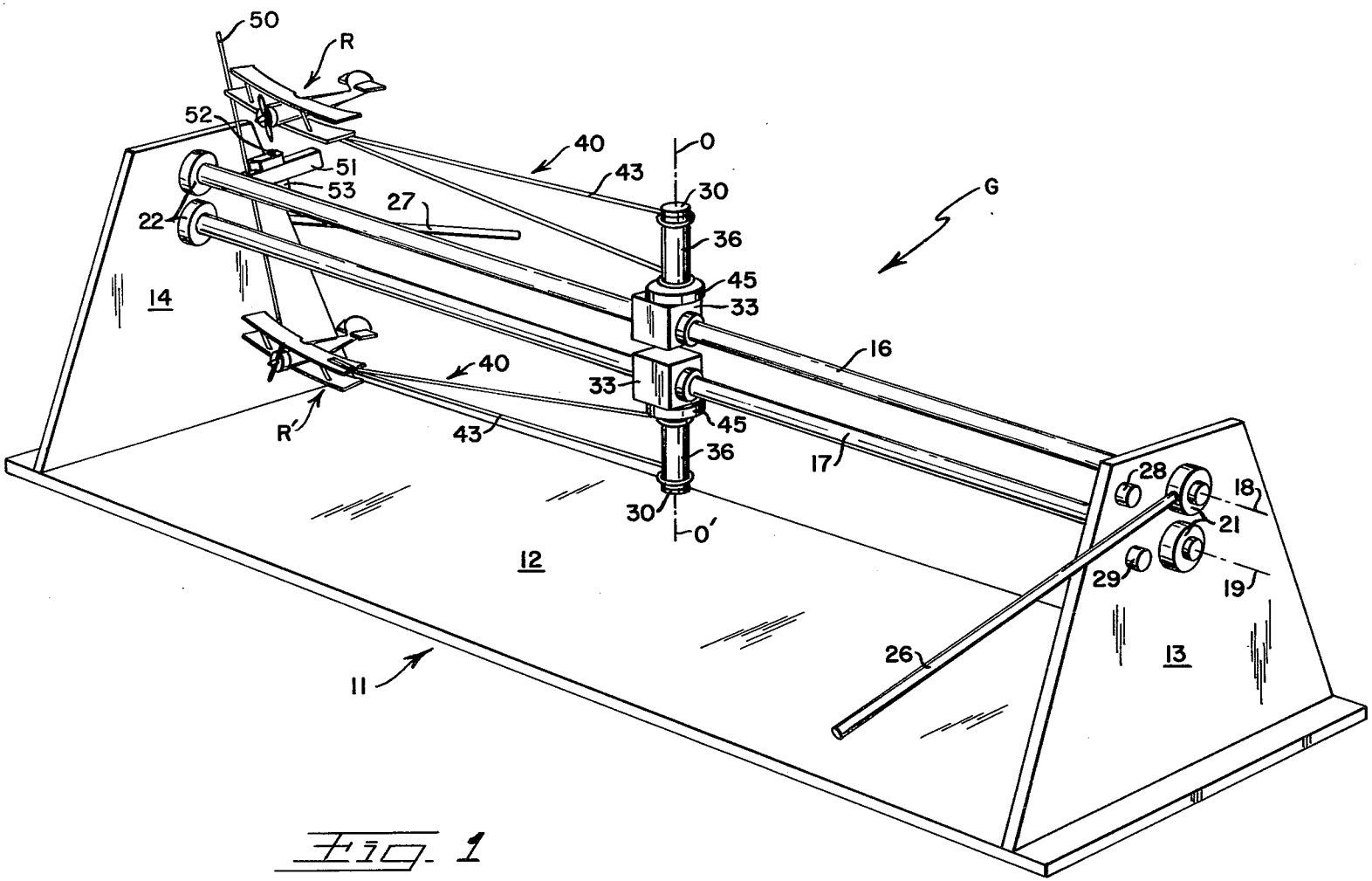
FIG. 1 is a perspective view of a racing game structured in accordance with a preferred embodiment of the invention.
Figure 2:
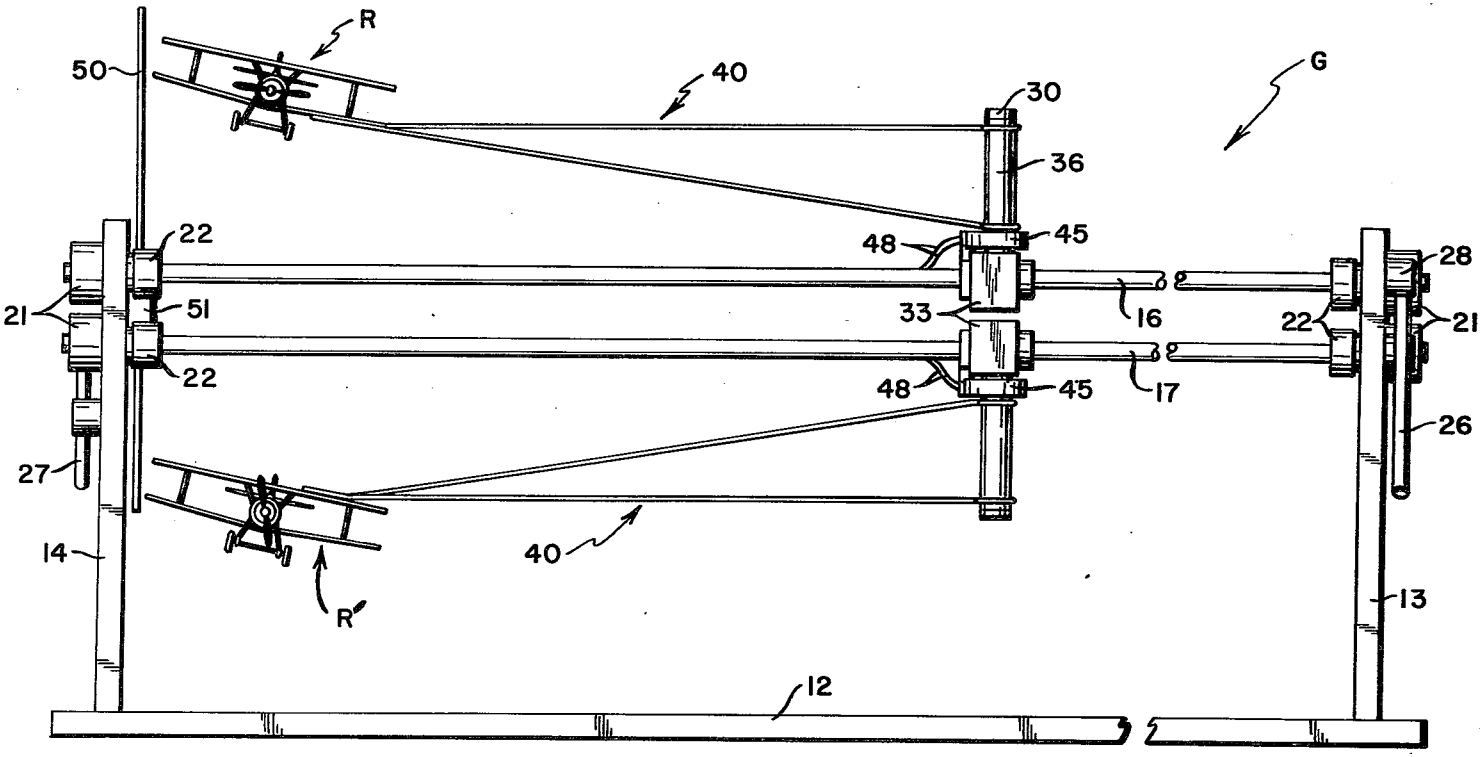
FIGS. 2 and 3 are front and side elevational views, respectively, of the racing games depicted in FIG. 1.
Figure 3:
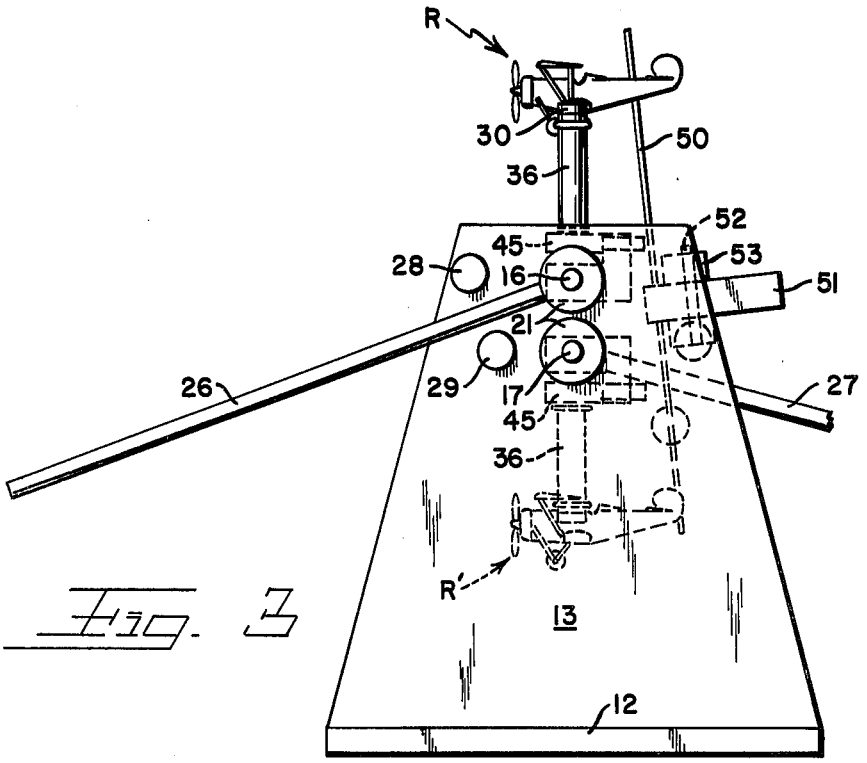

Referring now to the drawings, a preferred embodiment of my racing game G is shown to comprise a pair of toy airplanes R, R′ which are movably mounted for movement about orbital axes O, O′, respectively. As will become apparent from the ensuing description, orbital movement is imparted to the airplane by the gravitational force along, and the velocity of such movement is governed by the skill of the player who, as will be explained in more detail below, controls the speed of the plane by adjusting the inclination of the plane's orbital axis. It should be noted at this point that while the particular racing game illustrated in the drawings is designed for two players, one player per airplane, one or more additional airplanes could be readily added to the game, thereby enabling more players to participate. Alternatively, the game could comprise only one airplane and, rather than having the players compete simultaneously, they would compete separately against the clock. While the game will be described with particular reference to racing "airplanes" other objects may, of course, be substituted.

As shown in FIG. 1, the racing game of the invention comprises a generally U-shaped frame 11 comprising a base portion 12 and a pair of spaced upright supports 13, 14. Rotatably mounted between supports 13, 14 is a pair of spaced, parallel shafts 16, 17 which extend in horizontal planes. Shafts 16, 17 are mounted for rotational movement about their respective longitudinal axes 18, 19 via bearings (not shown) fitted in suppports 13, 14. Axial movement of shafts 16, 17 is prevented by collars 21 and 22 which engage each shaft near the point at which the shafts engage the upright supports. Rotational movement of each shaft is controlled via control arms 26, 27, one being rigidly connected to each of the shafts. Control arms 26, 27 extend perpendicularly from shafts 16, 17, respectively, at a point just outside the upright supports. Pivotal movement of the control arms about longitudinal axes 18, 19 is limited to an angular range defined by a pair of stops 28, 29 which are rigidly fixed to each of the upright supports. In this manner the rotational movement of shafts 16, 17 is limited to a similar angular range. Preferably, stops 28, 29 are positioned to limit the angular range of the control arms to ±6 degrees.

Extending generally upwardly and downwardly, respectively, from each shaft 16, 17 midway between supports 13, 14 is a pin 30. Each of the pins projects from a support 33 which is rigidly coupled to the supporting shaft. A bushing or sleeve bearing 36 is fitted on each pin to rotate thereabout. Attached to each bushing is an A-frame tie-rod 40, and the racing objects, R, R′ are connected to the free-ends of tie-rods 43. The longitudinal axes of pins 30 define the orbital axes O, O′ of the racing objects R, R′.

In playing the game, each player varies the angular position of one of the control arms, for example arm 26. In doing so, he controls the angular position of shaft 16 which, in turn, controls the angle of inclination of orbital axis O.

Referring to the perspective view in FIG. 1, as the player moves control arm 26 downward toward stop 29, pin 30 pivots counterclockwise about axis 18 (i.e.) out of the plane of the drawing), thereby causing tie-rod 43 to pivot or swing, under the force of gravity, out of the plane of the drawing and about orbital axis O. The momentum of the tie-rod and airplane will cause the rod to move past the plane in which pin 30 is tilted. At this point, the player quickly moves control arm 26 upwardly toward stop 28, thereby causing pin 30 to pivot clockwise about axis 18 past vertical and away from the viewer. Such movement, of course, causes tie-rod 43 to continue swinging in a counterclockwise direction (as viewed from above). The player controls the speed of the airplane by synchronizing his movement of the control arm 26 with the position of the tie rod. As the velocity of the airplane increases, the position of the control arm must be changed with increasing frequency. Similarly, the movement of airplane R′ is controlled by control arm 27.

Figure 4:
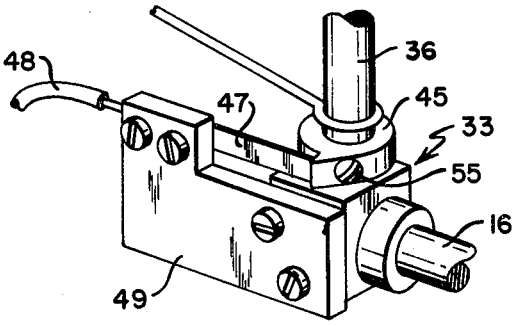
FIG. 4 is a perspective view of a lap-sensing mechanism.

To prevent the tie-rods from swinging in the direction opposite to that in which racing is desired, a one-tooth ratchet 45 is provided at the base of bushing 36. Referring to FIG. 4, ratchet 45 rotates with bushing 36 and a metal spring latch 47 mounted on an L-shaped bracket 47, acts to engage the tooth to prevent rotation. To count the number of orbits or laps made by each racing object, metal spring latch 47 can be connected by wire 48 to one pole of a D.C. battery (not shown) and a metal contact 55 can be mounted on the periphery of ratchet 45 which like bracket 49, is made of a non-conductive material. Contact 55 is connected to the opposite pole of the battery through the conductive frame of the game. Thus, as bushing 36 rotates, contact 55 periodically contacts spring latch 47 and thereby periodically completes an electrical circuit. A conventional electronic display (not shown) can be provided to sense and count the number of times the circuit is completed.

To assure that both airplanes R, R′ start at the same point in their respective closed loop paths, a starting post 50 is provided. Post 50 is secured to one end of a pivotally mounted arm 51 and, during pivotal movement of arm 51 about pivot pin 52, post 50 moves into and out of the path of movement of the airplanes. Pivot pin 52 is supported by a block 53 which is rigidly mounted on upright 14. In the drawings, arm 51 has been pivoted to position post 50 out of the racing path.

As mentioned above, it is possible to add one or more racing objects by simply adding additional supporting structure between the upright supports. Obviously, in competing against the clock, only one racing object and supporting structure need be provided.

While the invention has been described with particular reference to a preferred embodiment, variations and modifications will become self-evident to those skilled in the art without departing from the spirit and scope of the invention as defined by the appended claims.

I claim:

1. A racing game comprising:

(a) a pair of elongated members, each having a longitudinal axis extending along the length thereof;

(b) means for supporting said elongated members in spaced, substantially horizontal planes;

(c) a pair of pins, one rigidly coupled to each of said elongated members and extending outwardly therefrom in a substantially vertical direction, each of said pins having a longitudinal axis extending along the length thereof;

(d) a pair of tie-rods, each having opposed ends;

(e) means for supporting each of said tie-rods at one end thereof for pivotal movement about the longitudinal axis of one of said pins, said rods extending radially outwardly from said pins in a substantially horizontal plane, each of said rods terminating in a free end spaced from said pin;

(f) a pair of racing objects, one mounted at the free ends of each of said tie-rods;

(g) means for selectively rotating each of said elongated members about the respective longitudinal axis thereof to change the angular positions of the respective pins relative to said vertical direction, thereby causing said rods to rotate about said pins under the influence of gravity; and (h) means for limiting the rotational movement of said elongated members to limit the change in angular position of said pins to the same angular range.

2. The racing game of claim 1 wherein said angular range is approximately ±6 degrees relative to vertical.

3. A racing game comprising: an elongated pin having a longitudinal axis extending along the length thereof; an elongated member extending substantially perpendicular to said axis for supporting said pin in a generally upright position such that said longitudinal axis extends substantially parallel to the direction of the gravitational force; a racing object; an elongated rod having opposing ends; means for pivotally supporting said rod at one end thereof for pivotal movement about said axis; means for mounting said racing object to the opposite end of said rod; means for selectively varying the position of said pin to selectively vary the angular position of said axis relative to the direction of the gravitational force, whereby said rod may be caused to pivot, under the influence of gravity, about said axis, thereby producing an orbital movement of said racing object about said axis, said position varying means comprising means for rotating said elongated member about the longitudinal axis thereof; and means for limiting the rotational movement of said elongated member to limit the variation in angular position of said pin axis to a predetermined angular range.

4. The racing game of claim 3 wherein said means for pivotally supporting said rod comprises a bushing.

5. The racing game of claim 3 further copmrising means for sensing the completion of each orbit by said racing object.

6. A racing game comprising a racing object, an elongated tie-rod, first means for mounting said tie-rod at one end of pivotal movement about a substantially vertical axis, an elongated member for supporting said first mounting means, said member extending substantially perpendicular to said axis, second means for mounting said racing object at the opposite end of said tie-rod, and means for selectively varying the position of said first mounting means to tilt the position of said axis relative to the direction of gravitational force, whereby said rod will pivot about said axis under the influence of gravity and produce an orbital movement of said racing object about said axis, said means for selectively varying the position of said mounting means comprising means for supporting said elongated member for rotational movement about the longitudinal axis thereof, said movement being limited to a predetermined angular range.

7. The racing game of claim 6 further comprising means for sensing the completion of each orbit by said racing object.

8. A racing game comprising: an elongated pin having a longitudinal axis extending along the length thereof; means for supporting said pin in a generally upright position such that said longitudinal axis extends substantially parallel to the direction of the gravitational force; a racing object; an elongated rod having opposing ends; means for pivotally supporting said rod at one end thereof for pivotal movement about said axis; means for mounting said racing object to the opposite end of said rod; means for selectively varying the position of said pin to selectively vary the angular position of said axis relative to the direction of the gravitational force, whereby said rod may be caused to pivot, under the influence of gravity, about said axis, thereby producing an orbital movement of said racing object about said axis; and means for limiting the pivotal movement of said rod in one direction, whereby said racing object can orbit only in one direction.

9. A racing game comprising: a racing object; an elongated tie-rod, first means for mounting said tie-rod at one end for pivotal movement about a substantially vertical axis, second means for mounting said racing object at the opposite end of said tie-rod, means for selectively varying the position of said first mounting means to tilt the position of said axis relative to the direction of gravitational force, whereby said rod will pivot about said axis under the influence of gravity and produce an orbital movement of said racing object about said axis, and means for restricting the pivotal movement of said tie-rod in one direction, whereby said racing object can orbit only in one direction.

* * * * *